US006062468A

United States Patent [19]

Tausanovitch

[11] Patent Number: 6,062,468

[45] Date of Patent: May 16, 2000

[54] SERVING CONTAINER FOR FOOD AND CONDIMENT

[76] Inventor: Peter Tausanovitch, 58 Hardscrabble Rd., Lyme, N.H. 03768

[21] Appl. No.: 09/206,145

[22] Filed: Dec. 7, 1998

[51] Int. Cl.[7] ..... B65D 5/48

[52] U.S. Cl. ..... 229/120.32; 206/219; 220/359.2; 220/523; 220/529; 229/123.1; 229/400; 229/904; 229/906

[58] Field of Search ..... 229/120.32, 123.1, 229/400, 902, 904, 906; 220/359.1, 359.2, 359.4, 502, 505, 523, 529; 206/219, 221

[56] References Cited

U.S. PATENT DOCUMENTS

| | | | |
|---|---|---|---|
| D. 370,412 | 6/1996 | Rohrer | D9/347 |
| D. 373,081 | 8/1996 | Bridger | D9/430 |
| D. 376,311 | 12/1996 | Burton | D9/347 |
| 2,510,211 | 6/1950 | Cleary | 229/120.32 |
| 3,323,706 | 6/1967 | Gereke . | |
| 3,442,435 | 5/1969 | Ludder et al. . | |
| 3,561,664 | 2/1971 | Palmer . | |
| 3,902,120 | 8/1975 | Shveda | 206/217 |
| 3,920,120 | 11/1975 | Shveda | 229/400 |
| 4,039,435 | 8/1977 | Narva | 206/217 |
| 4,193,698 | 3/1980 | Gartner | 206/219 |
| 4,233,325 | 11/1980 | Slangan et al. | 206/219 |
| 4,955,528 | 9/1990 | Schluckebier | 229/120.18 |
| 5,012,971 | 5/1991 | Cozzi et al. | 229/120.07 |
| 5,316,603 | 5/1994 | Akazawa et al. | 220/359.4 |
| 5,514,394 | 5/1996 | Lenahan | 426/120 |
| 5,540,333 | 7/1996 | Gonzalez et al. | 206/541 |
| 5,842,631 | 12/1998 | Berger | 229/904 |

FOREIGN PATENT DOCUMENTS

| | | | |
|---|---|---|---|
| 50965 | 7/1974 | Australia | 229/123.1 |
| 2028802 | 4/1992 | Canada | 229/120.32 |

*Primary Examiner*—Gary E. Elkins
*Attorney, Agent, or Firm*—Michael J. Weins; Jeffrey E. Semprebon

[57] ABSTRACT

A serving container for an elongated food product and a condiment has a conduit formed by a sidewall having an upper sidewall region, which forms an open top, and a lower sidewall region. A condiment container is aligned with and affixed to the lower sidewall region, and has a container rim with leading and rim trailing edges. The condiment container is sealed by a sealing sheet which peelably engages the container rim, having leading and sheet trailing edges which respectively engage the leading and rim trailing edges. A tab attached to the sheet leading edge extends over the sealing sheet and is superimposed over the sheet trailing edge. The tab is maintained in close proximity to the rim trailing edge such that, when the tab is pulled, the pull on the sealing sheet is substantially parallel to the container rim, allowing the sealing sheet to be removed without dislodging a food product contained in the conduit. The tab may be so maintained by a slot in the sidewall through which the tab passes, a fixably positioned constraining edge under which the tab passes, or a rotatable crank onto which the tab is wound.

18 Claims, 8 Drawing Sheets

SERVING CONTAINER FOR FOOD AND CONDIMENT

FIELD OF THE INVENTION

The present invention relates to a serving container for an elongated food product, and more particularly for a serving container which also contains a condiment for the elongated food product.

BACKGROUND OF THE INVENTION

Elongated food products such as french fries are frequently served for consumption outside of a restaurant environment. They may be consumed in a vehicle, in the home, or while the consumer is in transit. These food products are frequently accompanied by a separate container of a condiment which is to be applied to the food product prior to consumption. For example, french fries are frequently served with a container of ketchup, french toast sticks or waffle sticks are served with a container of syrup, and chicken fingers are served with a container of dipping sauce. The condiment is provided in a separate container to prevent contact with the food product prior to consumption, which reduces undesirable sogginess and/or heat transfer. Furthermore, when the container is configured to allow dipping the food product, the user may apply the condiment only to one end of the food product, allowing the other end to be readily grasped without contacting the condiment. Such advantages of providing the condiment in a separate container may make such preferable even when the food is to be consumed at the site of food service.

Frequently, the location where the food is consumed has limited space upon which to place containers, so a separate condiment container is difficult to accommodate. Having a separate condiment container also adds to the number of items which must be served, increasing the difficulty of food service. Also, when a separate container is employed for the condiment, the act of dipping the food product creates a risk of spillage, which may soil the clothing of the consumer, furniture, or other surfaces. This is particularly a problem when such foods are consumed by children.

The problems of limited space for accommodating containers and the number of containers which must be served have in part been solved by serving containers which contain an integral condiment container, allowing the condiment to be contained in the same container as the food product. Such serving containers are taught in U.S. Pat. Nos. 4,955,528, 5,540,333, Des. 370,412, Des. 737,081, and Des. 376,311. These containers have the disadvantage that they do not allow the condiment to be prepackaged. Rather, the condiment container must be filled at the time of food service, thereby adding to the difficulty of such service and creating a risk of contamination of the condiment. Many of these containers place the condiment in close proximity to an open top of the condiment container, creating a risk of spillage.

To avoid the problems of filling the condiment containers at the time of food service, separate prepackaged condiment containers are frequently employed. Two such containers typically employed are tearable packets and tubs sealed by a removable sheet. In addition to increasing the number of items which must be served, such containers frequently result in waste items which are covered with the condiment. In the case of tearable packets, the condiment frequently oozes onto the surface of the packet when it is torn. In the case of tubs, the removable sheet is frequently covered with condiment on one side. These condiment-covered waste products create a risk of soiling clothing and other surfaces.

An additional problem with tearable packets is that it is difficult for the user to apply to condiment to only one end of the food product.

U.S. Pat. No. 3,442,435 teaches a serving container having a rim, to which can be attached a prepackaged condiment container. While the serving container of the '435 patent avoids increased difficulty of food service, the position of the condiment container on the rim of the serving container makes spillage a risk. When a prepackaged condiment container is employed, it is subject to the problems of the prepackaged tubs discussed above. Additionally, the placement of the condiment container on the rim obstructs the opening of the serving container, limiting the ability to readily fill the serving container to full capacity.

U.S. Pat. Nos. 3,561,664 and 4,039,435 teach containers for a single product having a bottom compartment which can be sealed with a sheet, where a pull tab on the sheet is employed to pull the sheet up off of the bottom compartment. Such containers would be unsuitable for serving a food product and a separate condiment, since pulling the sheet up would dislodge any contents placed above the sheet.

Thus, there is a need for a serving container which can contain both a food product and a separate condiment, which allows for use of prepackaged condiment containers while minimizing the potential for spillage and which avoids obstructing the opening of the serving container. There is also a need for a serving container which allows the use of prepackaged condiments while minimizing the problems of serving multiple items as well as the problems of condiment-covered waste products.

SUMMARY OF THE INVENTION

The present invention is a serving container for an elongated food product and a condiment in which the food product is to be dipped. The serving container has a conduit which forms part of the container and which supports a bundle of the elongated food product. The conduit is formed by a sidewall which terminates in an upper sidewall region, forming an open top for the serving container, and a lower sidewall region. The serving container may incorporate a modified conventional food container which serves as the conduit.

The serving container also has a condiment container having a container rim, which in turn has a rim leading edge and a rim trailing edge. Means for aligning and affixing the condiment container with respect the lower sidewall region of the conduit are provided, which serve to maintain the condiment container aligned and affixed with respect to the lower sidewall region when the serving container is in a service-ready condition. In such condition, the condiment container provides support for the food product when such is placed into the conduit through the open top.

The serving container can be configured such that the condiment container can be permanently affixed to the lower sidewall region of the conduit, such attachment providing the means for aligning and affixing the condiment container with respect the lower sidewall region of the conduit. Preferably, the assembled serving container is designed to be stackable to facilitate storage.

Alternatively, the serving container can be configured such that the conduit container is lockably engaged with respect to the lower sidewall region of the conduit at the time of food service. When the condiment container is so configured, the conduit can be designed to be stackable or collapsible to facilitate storage.

In all cases, the condiment container is sealed with a sealing sheet which peelably engages the container rim. The sealing sheet has a sheet leading edge which engages the rim leading edge and a sheet trailing edge which engages the rim trailing edge.

A tab is attached to the sheet leading edge of the sealing sheet. The tab is provided to allow the sealing sheet to be removed when the condiment container is aligned with and affixed to the conduit, which is then filled with the elongated food product. The tab is configured such that it can be extended over the sealing sheet and be superimposed thereon. The tab is sufficiently long as to allow it to reside on the sheet trailing edge and extend therebeyond. Preferably, the tab is flexible and, more preferably, is formed by an extension of the sealing sheet.

A means for maintaining the tab in close proximity to the rim trailing edge of the condiment container is provided. The means for maintaining the tab in close proximity to the rim trailing edge ensures that, when the tab is pulled to remove the sealing sheet from the container rim, the force on the sealing sheet is in a direction substantially parallel to the container rim. This force moves the sealing sheet along a path parallel to the container rim to assure that the sealing sheet is retracted without dislodging the food product from the conduit, allowing the food product to fall so that the ends of the food product drop into the condiment after the sealing sheet has been removed.

In several preferred embodiments, the lower sidewall region of the conduit is provided with a sidewall extension. In one class of preferred embodiments with a sidewall extension, the condiment container is sealed to the sidewall extension to provide the means for aligning and affixing the condiment container with respect the lower sidewall region.

In a second class of preferred embodiments employing a sidewall extension, the condiment container is attachable with a locking mechanism which provides the means for aligning and affixing the condiment container with respect the lower sidewall region. In one such preferred embodiment, the sidewall extension is provided with a first slot and a second slot, while the container rim is provided with a first rim extension which is engagable with the first slot and a second rim extension which is engagable with the second slot.

A conventional food container can be employed to provide the conduit, in which case the sidewall extension terminates in a bottom panel. The conventional food container is modified by providing the first slot and the second slot for engagement by the first rim extension and the second rim extension of the condiment container.

Another preferred configuration which can employ a modified conventional food container has an aperture cut into the sidewall extension, through which the condiment container can be inserted. When the condiment container is provided with a first rim extension and a second rim extension, the top of the aperture can serve as either the first slot or the second slot for engaging either the first rim extension or the second rim extension. If greater flexibility in the size of the aperture is required to aid in the insertion of the condiment container, the aperture can be increased in size and a flap attached to the aperture which, when lowered, reduces the effective size of the aperture. If no aperture is provided, the condiment container is inserted through the open top of the conduit and snapped into engagement therewith.

Another embodiment of the present invention does not require modification of a conventional serving container, but employs a specially adapted condiment container which is affixed to the sidewall extension with adhesive.

Various means for maintaining the tab in close proximity to the rim trailing edge may be employed, and the means employed in a particular embodiment may depend in part on the means for aligning and affixing the condiment container with respect to the lower sidewall region which are employed.

When the condiment container is attached onto the lower sidewall region or is inserted through an aperture therein, a crank and spindle assembly mounted with respect to the container rim can be employed to provide the means for maintaining the tab in close proximity to the rim trailing edge. The crank is configured to be manually turned by a user of the serving container. When the crank is turned, the tab and the sealing sheet are wound onto the spindle. This has a benefit in that the sealing sheet is retained, reducing the number of waste items to for disposal and reducing chances of soiling if the sealing sheet is covered with condiment.

Another preferred embodiment of a means for maintaining the tab in close proximity to the rim trailing edge is a tab slot in the sidewall, through which the tab passes. When a first rim extension and a second rim extension are provided on the condiment container for engaging a first slot and a second slot in the lower sidewall region, the second slot is preferably configured such that it accommodates both the second rim extension and the tab. The second slot thus serves as the tab slot to provide the means for maintaining the tab in close proximity to the rim trailing edge. As discussed above, an aperture can be employed to provide the second slot to allow inserting the condiment container through the sidewall.

In such embodiments, a portion of the sidewall bordering the tab slot can be formed as a flap which engages the tab and sealing sheet as they are pulled from the container rim of the condiment container, the flap serving to wipe the sealing sheet as it is pulled from the container rim of the condiment container to remove any condiment which may be stuck to the sealing sheet. In this manner, the problem of condiment-covered waste products associated with prepackaged condiment containers is reduced.

Yet another means for maintaining the tab in close proximity to the rim trailing edge is a constraining edge fixably positioned with respect to the rim trailing edge of the condiment container. The tab passes beneath the constraining edge. While the constraining edge may also serve to wipe the sealing sheet to remove the condiment from the sheet, it is further preferred for the portion of the sealing sheet which may have any residual condiment to be maintained within the sidewall. Such may be accomplished by extending the tab along a portion of the sidewall to the open top, where it can readily be grasped by the user to peel off the sealing sheet while it remains inside the conduit.

BEST MODE OF CARRYING THE INVENTION INTO PRACTICE

Figure 1:
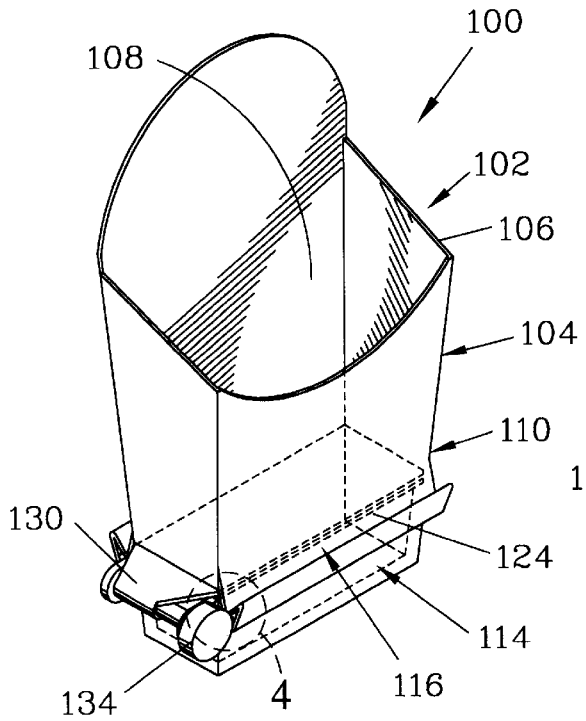
FIG. 1 is an isometric view of a serving container which forms one embodiment of the present invention. The serving container has a conduit having an open top, a sidewall, and a bottom panel, and attached thereto is a condiment container.
Figure 2:
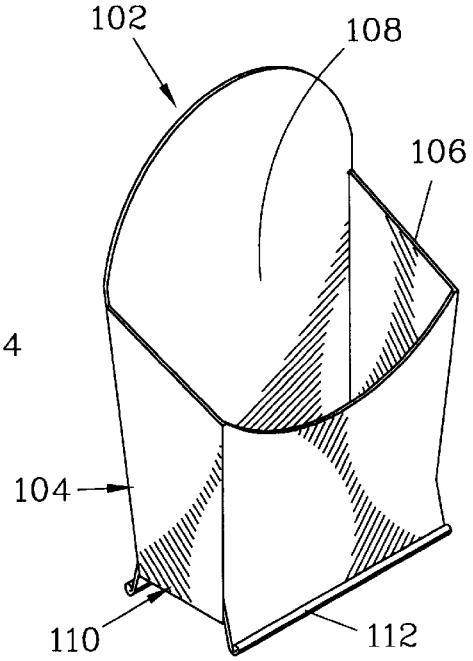
FIG. 2 is an isometric view of the conduit of the embodiment shown in FIG. 1. The conduit serves to store a bundle of an elongated food product. The conduit can be stored by stacking or by folding.
Figure 3:
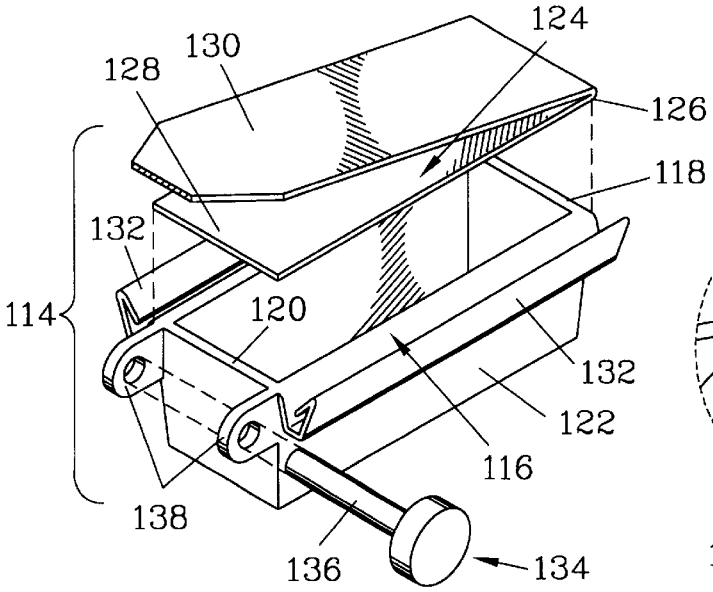
FIG. 3 is an exploded isometric view of the condiment container shown in FIG. 1, which is sealed by a sealing sheet and a tab. In this embodiment, a crank and spindle are employed to retract the sealing sheet while maintaining the tab in close proximity to a rim trailing edge of the condiment container.
Figure 4:
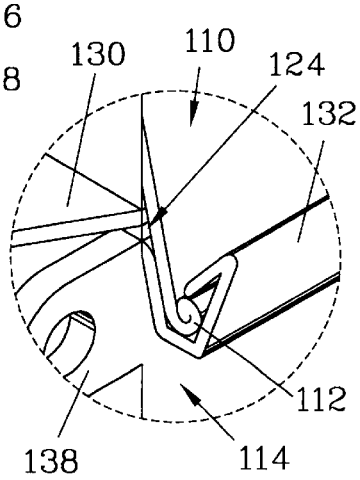
FIG. 4 is a enlargement of the region 4 of FIG. 1 which illustrates the locking mechanism employed to affix the condiment container to the conduit. In this embodiment, a bead is provided on the lower sidewall region of the sidewall and locking channels provided on the condiment container are configured to engage the bead.
Figure 5:
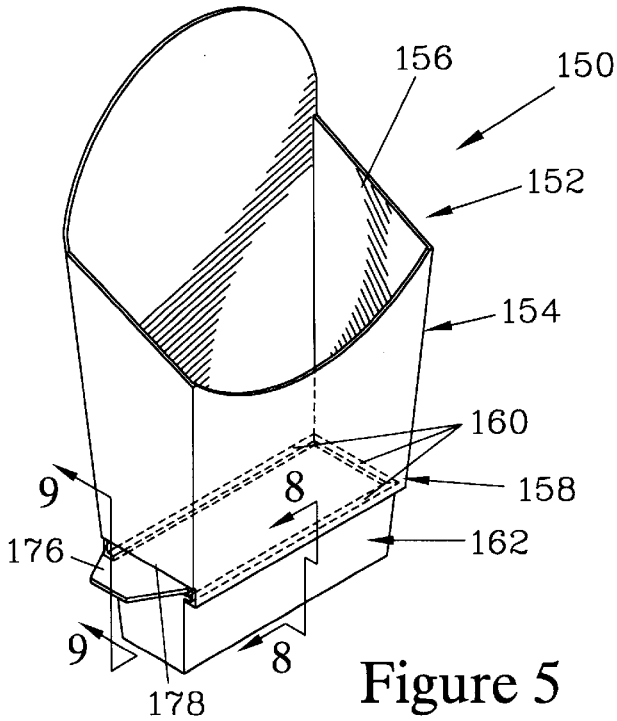
FIG. 5 is an isometric view of another embodiment of the present invention, which is similar to the embodiment shown in FIGS. 1–4, but where the condiment container is permanently affixed to the conduit. In this embodiment, the condiment container is bonded to flange edges on the lower sidewall region of the conduit. Additionally, the tab is configured to be pulled by the user to retract the sealing sheet.
Figure 6:
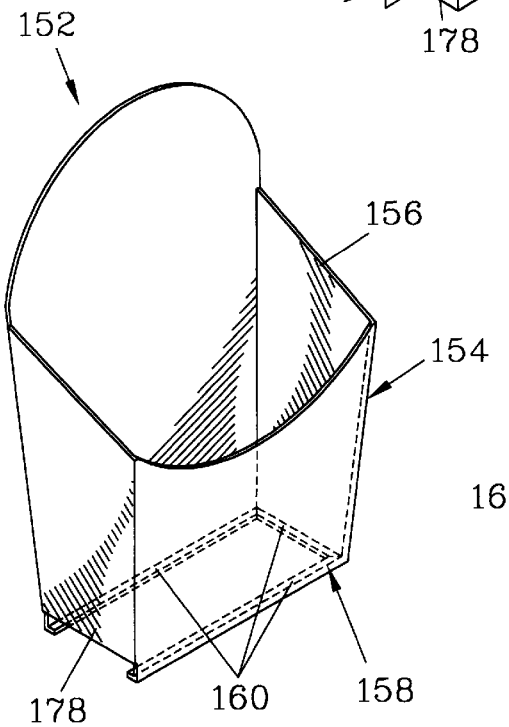
FIG. 6 is an isometric view of the conduit of the embodiment shown in FIG. 5.
Figure 7:
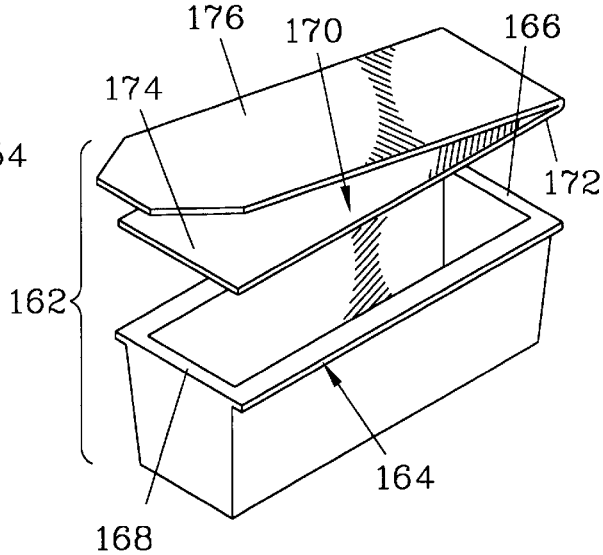
FIG. 7 is an exploded isometric view of the condiment container shown in FIG. 5.

FIGS. 1 through 4 illustrate one embodiment of the present invention. FIG. 1 is an isometric view of an assembled serving container 100. The serving container 100 has a conduit 102 (shown in FIG. 1 and separately depicted in FIG. 2) for holding an elongated food product (not shown) such as french fries, waffle sticks, chicken fingers, or the like. The conduit 102 is formed by a sidewall 104 which terminates in an upper sidewall region 106, which forms an open top 108, and a lower sidewall region 110. In this embodiment, the lower sidewall region 110 is provided with a bead 112, which may be fabricated by rolling the edge of the lower sidewall region 110. The bead 112 serves as locking edges on the lower sidewall region 110.

The serving container 100 also has a condiment container 114 (shown in detail in FIG. 3) which is designed to hold a condiment (not shown) for the food product. The condiment container 114 can be aligned with and affixed to the lower sidewall region 110 of the conduit 102, as shown in FIG. 1 and as is discussed below. The condiment container 114 has a container rim 116 (best shown in FIG. 3) with a rim leading edge 118 and a rim trailing edge 120. A reservoir 122 is attached below the container rim 116 to contain the condiment.

A sealing sheet 124 is peelably attached to the container rim 116 to cover the condiment container 114. The sealing sheet 124 allows the condiment container 114 to be prepackaged for increased ease of food service and extended shelf life of the condiment. The sealing sheet 124 has a sheet leading edge 126 which engages the rim leading edge 118, and a sheet trailing edge 128 which engages the rim trailing edge 120.

A tab 130 is formed by an extension of the sealing sheet 124 and attaches to the sheet leading edge 126. The tab 130 extends over the sealing sheet 124 and extends beyond the sheet trailing edge 128.

To provide means for aligning and affixing the condiment container 114 to the lower sidewall region 110 of the conduit 102, a pair of locking channels 132 are provided on the container rim 114. The pair of locking channels 132 are configured to be lockably engagable with the bead 112 of the lower sidewall region 110, as shown in the detail view of FIG. 4. The lockable engagement of the pair of locking channels 132 with the bead 112 serves to lock the condiment container 114 in position with respect to the conduit 102, and facilitates food service since the condiment container 114 and the conduit 102 are simply snapped together to load the serving container 100 with the condiment. The food product may then be loaded into the conduit 102 through the open top 108, and the tab 130 and sealing sheet 124 provide support for the food product.

In the serving container 100, a crank 134 is employed to provide means for maintaining the tab 130 in close proximity to the rim trailing edge 120. The crank 134 is configured to be manually turned by a user of the serving container 100, and has a spindle 136 to which the tab 130 is fixably attached. The crank 134 is rotatably mounted in a position fixed with respect to the rim trailing edge 120. A pair of crank brackets 138 are affixed to the condiment container 114 in the vicinity of the rim trailing edge 120, and the crank 134 rotatably engages the pair of crank brackets 138. Thus, the pair of crank brackets 138 provide means for rotatably retaining the crank 134 in a fixed position relative to the rim trailing edge 120.

As the crank 134 is turned, the tab 130 and the sealing sheet 124 are sequentially wound onto the spindle 136. The crank 134 serves to pull the tab 130 and the sealing sheet 124 such that the pull on the sealing sheet 124 is in a direction substantially parallel to the container rim 116. The user may thus readily remove the tab 130 and the sealing sheet 124 from the container rim 116 of the condiment container 114 without dislodging the food product. The food product may then drop into the condiment container 114, falling partially into the condiment contained in the reservoir 122 so as to be covered with condiment on one end.

While the use of the crank 134 to provide means for maintaining the tab 130 in close proximity to the rim trailing edge 120 results in a complicated structure for the serving container 100, it has the benefit of retaining the sealing sheet 124, minimizing the number of waste articles to be discarded after use. Additionally, the action of manipulating the crank 134 is felt to have great appeal for children, and the turning motion of the crank 134 may be incorporated into a decorative theme on the serving container 100.

FIGS. 5 through 10 illustrate a serving container 150 which forms another embodiment of the present invention. The serving container 150 again has a conduit 152 formed by a sidewall 154 terminating in an upper sidewall region 156 and a lower sidewall region 158. In this embodiment, the lower sidewall region 158 of the conduit 152 is provided with three flange edges 160, one of which is better shown in FIG. 8.

Figure 8:
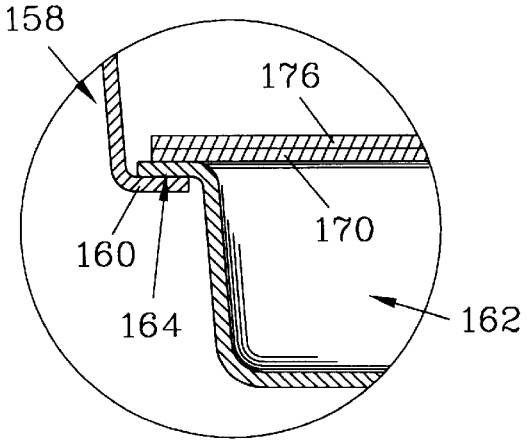
FIGS. 8 and 9 are respective enlarged views of section 8—8 and section 9—9 of FIG. 5.

A condiment container 162 is provided (best shown in FIG. 7), which has a container rim 164 with a rim leading edge 166 and a rim trailing edge 168. The condiment container 162 in this embodiment is affixed to the lower sidewall region 158 of the conduit 152 prior to the time of food service. The container rim 164 of the condiment container 162 is fixably attached to the flange edges 160 of the conduit 152 by adhesive or similar means of attachment, as shown in FIG. 8.

A sealing sheet 170 is attached to the container rim 164. The sealing sheet 170 has a sheet leading edge 172 which engages the rim leading edge 166, and a sheet trailing edge 174 which engages the rim trailing edge 168.

A tab 176 is formed by an extension of the sealing sheet 170, and extends from the sheet leading edge 172, over the sealing sheet 170, and beyond the sheet trailing edge 174. In this embodiment, the tab 176 is configured to be manually pulled by the user to remove the sealing sheet 170 from the container rim 164.

Figure 9:
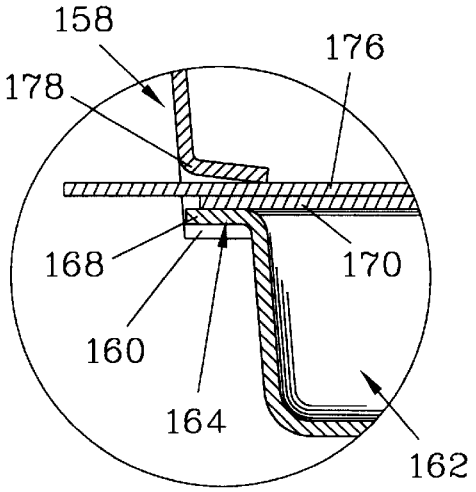

The condiment container 162 is positioned relative to the conduit 152 such that the rim trailing edge 168 and the tab 176 are positioned beneath a constraining edge 178 provided on the lower sidewall region 158 of the conduit 152, as best shown in FIG. 9. Since the condiment container 162 is fixably attached to the conduit 152, the constraining edge 178 provides means for maintaining the tab 176 in close proximity to the rim trailing edge 168.

The constraining edge 178 constrains the motion of the tab 176 when the tab 176 is pulled by a user to remove the sealing sheet 170 from the container rim 164 of the condiment container 162. The constraining edge 178 assures that the pull on the sealing sheet 170 is in a direction substantially parallel to the container rim 164. The user may thus readily remove the tab 176 and the sealing sheet 170 without dislodging the food product, which is thereafter free to drop into the condiment container 162 to be partially covered by condiment prior to consumption.

Additionally, the constraining edge 178 can serve to wipe the sealing sheet 170 if the user pulls the tab 176 upwards against the constraining edge 178. As the user pulls the tab 176 upwards and the sealing sheet 170 is pulled from engagement with the container rim 164, the sealing sheet 170 is eventually pulled against the constraining edge 178, and any condiment which is stuck to the sealing sheet 170 is wiped off by the constraining edge 178 as the tab 176 and sealing sheet 170 are pulled out. Thus, the sealing sheet 170 is mostly free of the condiment when it is removed from the serving container 150.

Figure 10:
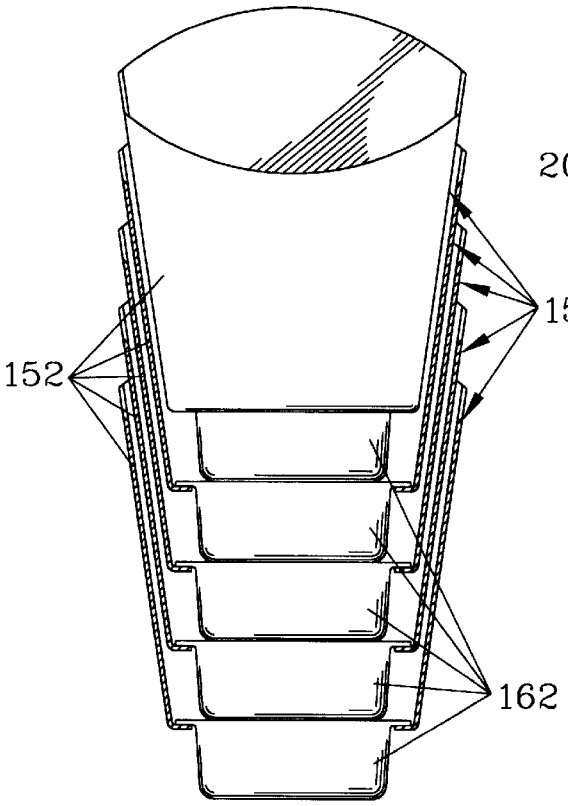
FIG. 10 illustrates the stacking of an array of the serving containers illustrated in FIG. 5.

The fixable attachment of the condiment container 162 to the conduit 152 facilitates food service, since the alignment and affixing of the condiment container 162 to the conduit 152 is performed prior to the time of service. Preferably, the conduit 152 and the condiment container 162 are configured such that several assembled serving containers 150 may be readily stacked for compact storage at the food service site, as is shown in FIG. 10.

Figure 11:
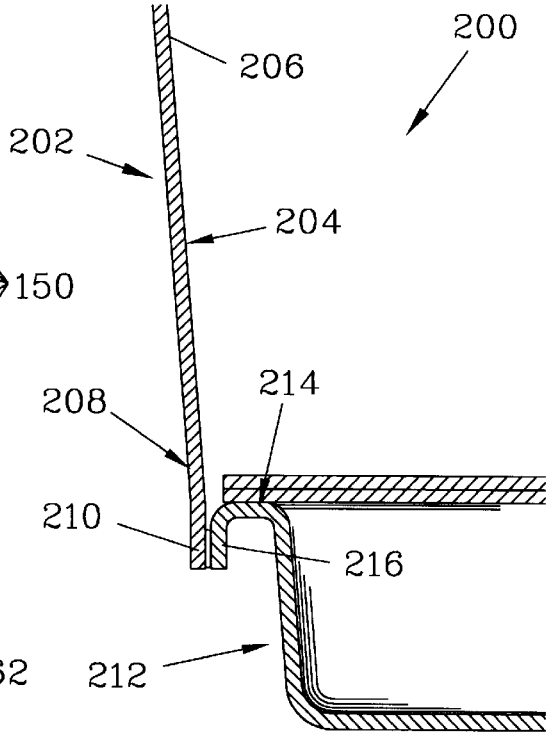
FIG. 11 is a partial view of an embodiment which is similar to the embodiment illustrated in FIGS. 5–10 and which differs in that the sidewall which forms the conduit has a sidewall extension to which the condiment container is affixed.

FIG. 11 is a partial section view of a serving container 200 which is similar to the serving container 150 shown in FIGS. 5–10. The serving container 200 again has a conduit 202 formed by a sidewall 204 terminating in an upper sidewall region 206 and a lower sidewall region 208. In this embodiment, the lower sidewall region 208 of the conduit 202 is provided with a sidewall extension 210.

A condiment container 212 is provided, having a container rim 214. The container rim 214 of this embodiment has attachment flaps 216 which are fixably attached to the sidewall extension 210. The attachment flaps 216 can be affixed to the sidewall extension 210 by adhesive such as a glue, or by providing either the attachment flaps 216 or the sidewall extension 210 with an adhesive layer covered by a peel-off sheet which is removed immediately prior to attachment.

FIGS. 12 through 15 illustrate another embodiment of the present invention, a serving container 250. The serving container 250 has a conduit 252 (shown in FIG. 12 and separately depicted in FIG. 13) for holding an elongated food product. The conduit 252 is again formed by a sidewall 254 terminating in an upper sidewall region 256 and a lower sidewall region 258. The upper sidewall region 256 forms an open top 260, while the lower sidewall region 258 is provided with a sidewall extension 262 which terminates in a bottom panel 264.

The conduit 252 of this embodiment may be provided by modifying a conventional food container such as a box designed to hold french fries. The sidewall extension 262 is provided with a tab slot 266 and a loading aperture 268. The loading aperture 268 is preferably positioned on the sidewall extension 262 so as to provide a ledge 270. A conventional food container may be modified to provide the conduit 252 by cutting the tab slot 266 and the loading aperture 268 into the conventional food container. Preferably, the conduit 252 may be stacked or collapsed for compact storage.

Figure 12:
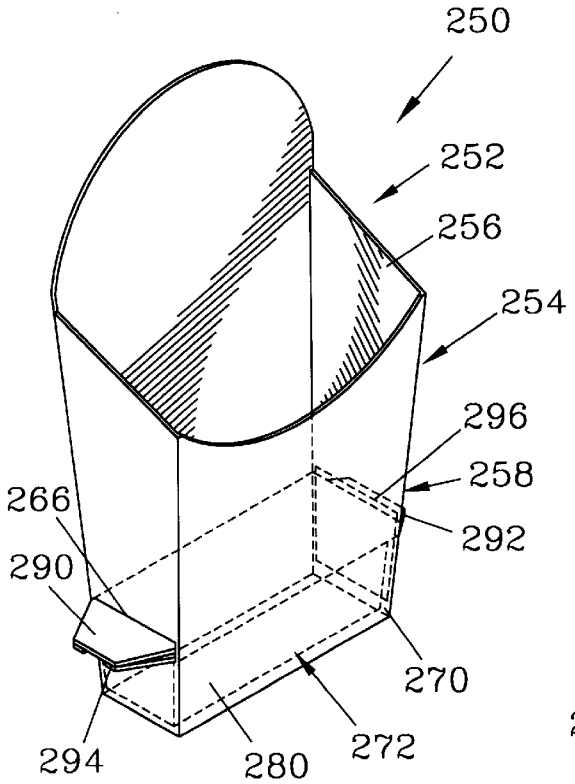
FIG. 12 is an isometric view of another embodiment of the present invention, which employs a conduit having a sidewall extension terminated by a bottom panel. The conduit can be fabricated from a conventional food container which has been modified by providing a tab slot and an aperture for insertion of the condiment container.
Figure 13:
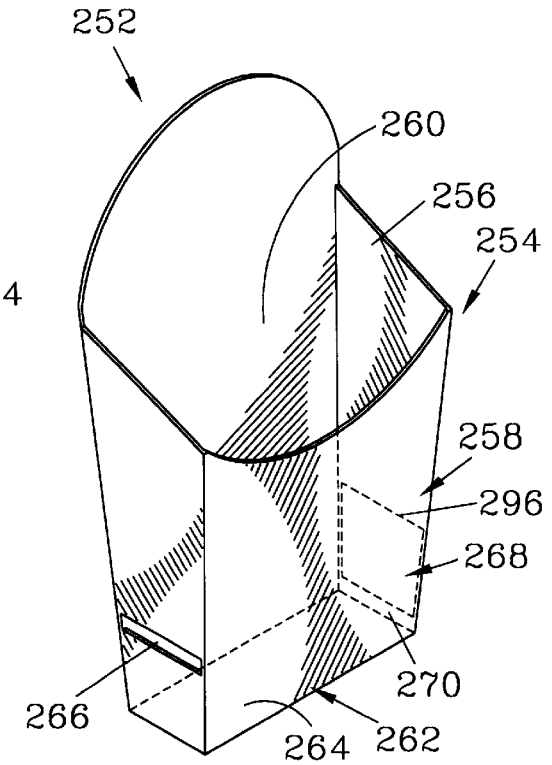
FIG. 13 is an isometric view of the conduit shown in FIG. 12, showing how the conduit can be readily fabricated from a conventional food container.
Figure 14:
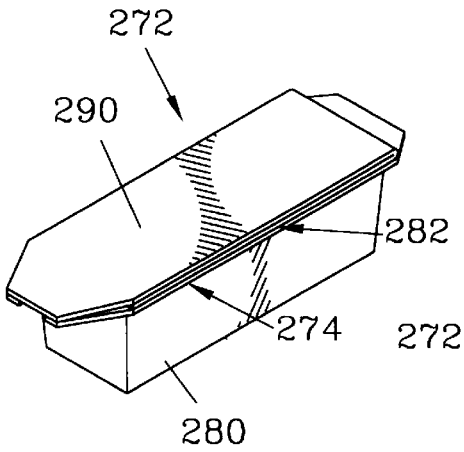
FIG. 14 is an isometric view of the condiment container which is employed in the embodiment shown in FIG. 12.
Figure 15:
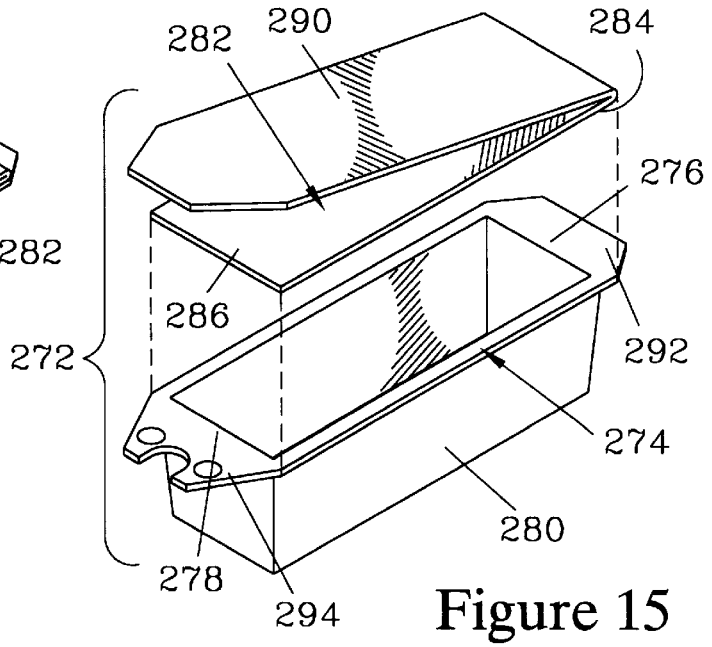
FIG. 15 is an exploded isometric view of the condiment container illustrated in FIG. 14.

The serving container 250 also has a condiment container 272 illustrated as an assembled condiment container in FIG. 14 and in an exploded isometric view in FIG. 15. The condiment container 272 holds a condiment for the food product, and can be lockably engaged with the lower sidewall region 258 of the conduit 252, as shown in FIG. 12 and discussed below. The condiment container 272 again has a container rim 274 (best shown in FIG. 15) with a rim leading edge 276 and a rim trailing edge 278, and has a reservoir 280.

A sealing sheet 282 is attached to the container rim 274, the sealing sheet 282 having a sheet leading edge 284 which engages the rim leading edge 276, and a sheet trailing edge 286 which engages the rim trailing edge 278. A tab 290 is formed by an extension of the sealing sheet 282 and extends over the sealing sheet 282 and beyond the sheet trailing edge 286.

The condiment container 272 is placed into the conduit 252 by inserting the condiment container 272 through the loading aperture 268. When the condiment container 272 is inserted into the conduit 252, the tab 290 is inserted through the tab slot 266 in the sidewall extension 262. Preferably, the tab 290 is releasably attached to the condiment container 272 in the vicinity of the sheet trailing edge 286 to facilitate positioning the tab 290 through the tab slot 266.

When the condiment container 272 is installed, the reservoir 280 engages the ledge 270 to prevent the condiment container from sliding out of the conduit 252. A first rim extension 292 is provided on the container rim 274 in the vicinity of the rim leading edge 276, and a second rim extension 294 is provided on the container rim 274 in the vicinity of the rim trailing edge 278, where it underlies part of the tab 290.

The first rim extension 292 is positioned to be engagable with an aperture upper edge 296 of the loading aperture 268 to constrain upwards motion of the condiment container 272 in the vicinity of the rim leading edge 276. This limits any rotation of the condiment container 272 with respect to the lower sidewall region 258 when the tab 290 is pulled. The aperture upper edge 296 of the loading aperture 268 thus serves as a first slot for engaging the first rim extension 292.

The second rim extension 294 is positioned to support the tab 290 to constrain upwards motion of the condiment container 272 when the tab 290 engages the tab slot 266 of the sidewall 254. In this embodiment, the tab slot 266 thus also serves as a second slot for engaging the second rim extension 294.

In combination, the engagement of the reservoir 280 with the ledge 270, of the first rim extension 292 with the aperture upper edge 296, and of the second rim extension 294 with the tab slot 266 serve to lock the condiment container 272 in position with respect to the lower sidewall region 258.

In this embodiment, the tab slot 266 also provides means for maintaining the tab 290 in close proximity to the rim trailing edge 278. The tab slot 266 constrains the motion of the tab 290 to ensure that, when the tab 290 is pulled by a user to remove the sealing sheet 282 from the container rim 274 of the condiment container 272, the pull on the sealing sheet 282 is in a direction substantially parallel to the container rim 274. The tab slot 266 may also serve to wipe the sealing sheet 282 as the user pulls the tab 290.

Figure 16:
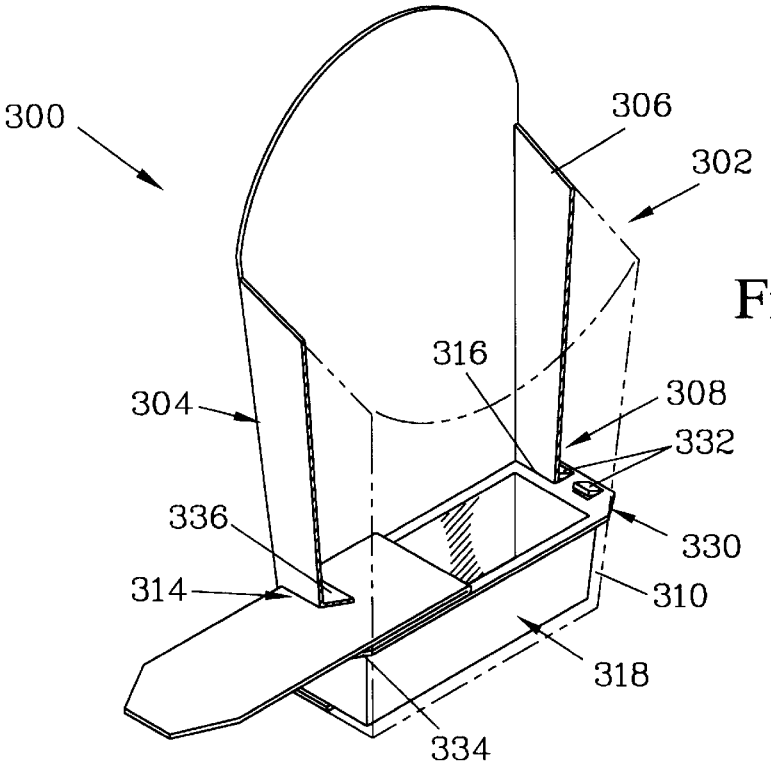
FIGS. 16–18 are isometric views of another embodiment of the present invention, which is similar to the embodiment of FIGS. 12–15 and differs in details of the means for affixing the condiment container to the conduit.
Figure 17:
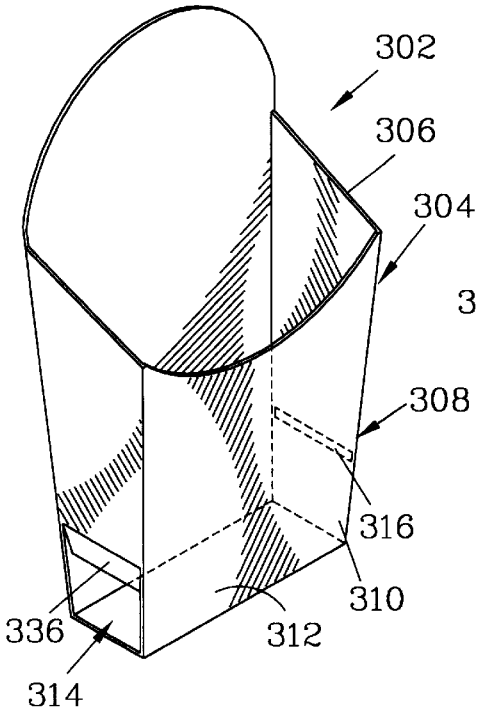
Figure 18:
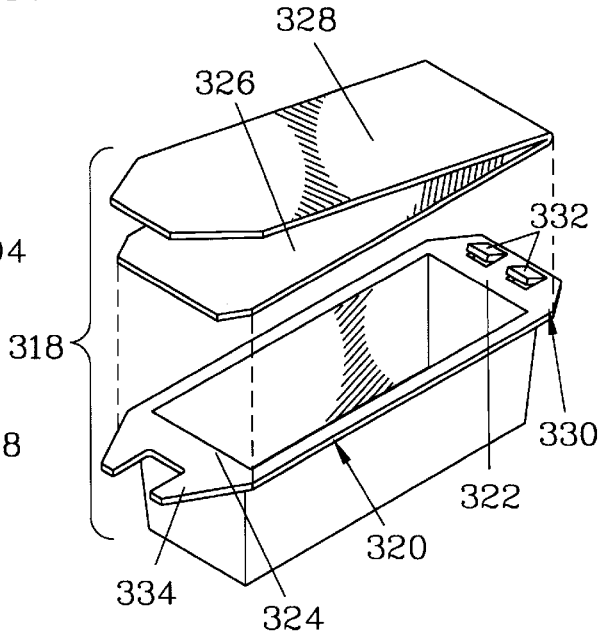

FIGS. 16 through 18 illustrate another embodiment of the present invention, a serving container 300, which shares many features in common with the serving container 250 shown in FIGS. 12–15. The serving container 300 again has a conduit 302, shown with a section broken away in FIG. 16 and in its entirety in FIG. 17. The conduit 302 is formed by a sidewall 304 terminating in an upper sidewall region 306 and a lower sidewall region 308, the lower sidewall region 308 again having a sidewall extension 310 terminating in a bottom panel 312.

The sidewall extension 310 of the serving container 300 is provided with a loading aperture 314, and has a first slot 316. Again, a conventional food container could be employed for the conduit 302 by cutting the loading aperture 314 and the first slot 316 into the conventional food container.

The serving container 300 has a condiment container 318 which is shown in an exploded isometric view in FIG. 18. The condiment container can be lockably engaged with the sidewall extension 310 of the conduit 302 as is described below. The condiment container 318 has a container rim 320 with a rim leading edge 322 and a rim trailing edge 324. A sealing sheet 326 is attached to the container rim 320 and a tab 328 is formed by an extension of the sealing sheet 326.

A first rim extension 330 is provided in the vicinity of the rim leading edge 322, and is provided with one or more anchor flaps 332. The condiment container 318 is placed into the conduit 302 through the loading aperture 314 in the sidewall extension 310, and is placed such that the first rim extension 330 extends through the first slot 316 in the sidewall extension 310. Once the first rim extension 330 is passed through the first slot 316, the anchor flaps 332 engage the first slot 316 to prevent the first rim extension 330 from being removed therefrom. The engagement of the first rim extension 330 with the first slot 316 prevents the condiment container 318 from being pulled out of the conduit 302 through the loading aperture 314.

A second rim extension 334 is provided in the vicinity of the rim trailing edge 324 and partially underlies the tab 328. The loading aperture 314 is preferably provided with a wiper flap 336 which engages the tab 328 where it is superimposed over the second rim extension 334, the loading aperture 314 serving as a second slot. The second rim extension 334 supports the tab 328 in engaging the wiper flap 336 to constrain upwards motion of the condiment container 318.

In combination, the engagement of the first rim extension 330 with the first slot 316 and of the second rim extension 334 with the wiper flap 336 serve to affix the condiment container 318 in position with respect to the lower sidewall region 308.

The wiper flap 336 also provides a means for maintaining the tab 328 in close proximity to the rim trailing edge 324. The wiper flap 336 resiliently constrains the tab 328, which passes under the wiper flap 336 and extends through the loading aperture 314. When the tab 328 is pulled, the resilient constraint of the wiper flap 336 limits upwards motion of the tab 328 to provide a pull on the sealing sheet 326 which is in a direction substantially parallel to the container rim 320. The wiper flap 336 also serves to wipe the sealing sheet 326 as the user pulls the tab 328 to remove the sealing sheet 326.

Figure 19:
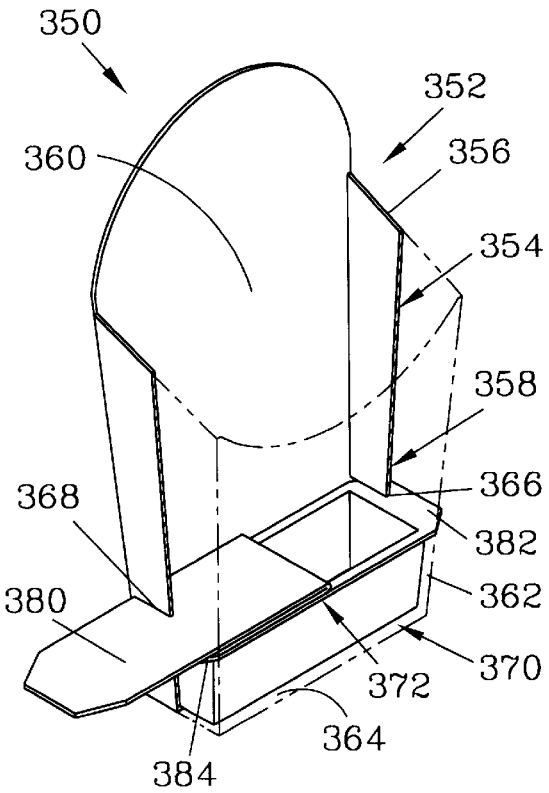
FIG. 19 is an isometric view of another embodiment of the present invention which uses a modified conventional food container to form a conduit having a sidewall extension and a bottom panel. This embodiment differs in part from the embodiments of FIGS. 12–18 in that the condiment container is loaded through the top of the conduit.
Figure 20:
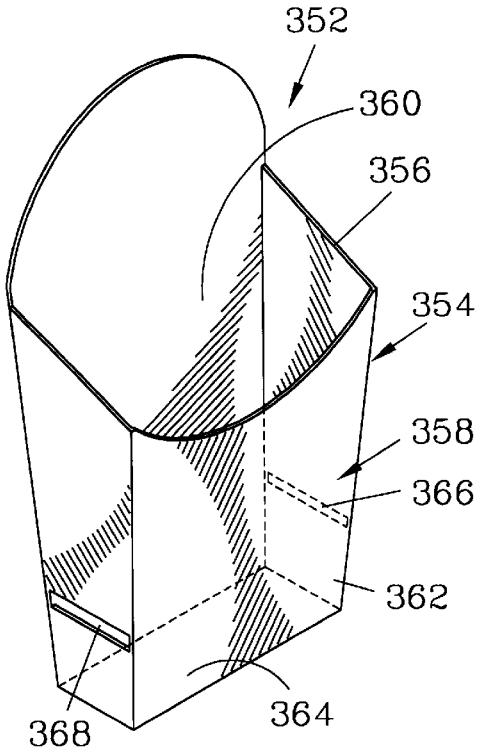
FIG. 20 is an isometric view of the conduit shown in FIG. 19.

FIGS. 19 through 22 illustrate yet another embodiment of the present invention. FIG. 19 is an isometric view of a serving container 350 which shares many features in common with the serving containers discussed above, but which features "drop-in" loading, as is discussed below. The serving container 350 has a conduit 352, shown separately in FIG. 20. The conduit 352 is formed by a sidewall 354 terminating in an upper sidewall region 356 and a lower sidewall region 358. Again, the upper sidewall region 356 forms an open top 360, and the lower sidewall region 358 has a sidewall extension 362 terminating in a bottom panel 364.

The lower sidewall region 358 of the serving container 350 is provided with a first slot 366 and a tab slot 368. Yet again, a conventional food container could be employed for the conduit 352 by cutting the first slot 366 and the tab slot 368 into the food container. Since the conduit 352 of this embodiment does not employ a loading aperture such as the loading apertures (268, 314) discussed above, the conduit 352 may be used independently to contain the food item (not shown) when the food item is sufficiently large as to avoid passage through either the first slot 366 or the tab slot 368. The ability to use the conduit 352 either independently as a conventional food container or as a component of the serving container 350 avoids the need to maintain separate inventories of conduits 352 and conventional food containers for separate uses.

Figure 21:
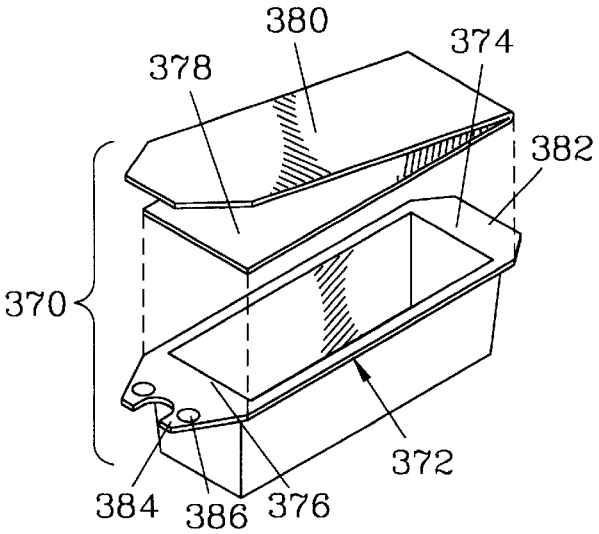
FIG. 21 is an exploded isometric view of the condiment container shown in FIG. 19.
Figure 22:
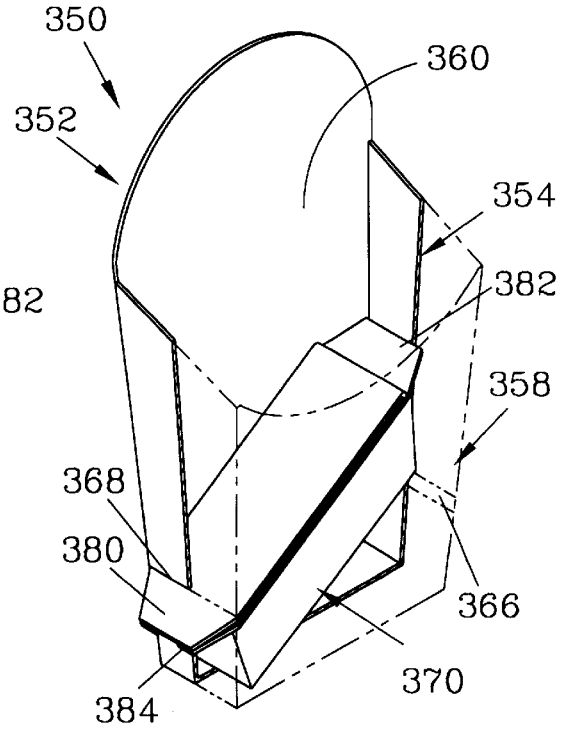
FIG. 22 illustrates the placement of the condiment container shown in FIG. 21 into the conduit shown in FIG. 20.

The serving container 350 has a condiment container 370, shown in an exploded isometric view in FIG. 21. The condiment container 370 is designed to be lockably engaged with the lower sidewall region 358 of the conduit 352. The condiment container 370 has a container rim 372 with a rim leading edge 374 and a rim trailing edge 376. A sealing sheet 378 is attached to the container rim 372, and a tab 380 is formed by an extension of the sealing sheet 378. It is preferred for the tab 380 to be releasably attached to the condiment container 370 in the vicinity of the rim trailing edge 376 to facilitate positioning the tab 380 through the tab slot 368 in the sidewall 356 when the condiment container 370 is loaded into the conduit 352, as shown in FIG. 22.

An extension of the container rim 372 in the vicinity of the rim leading edge 374 forms a first rim extension 382, while an extension of the container rim 372 in the vicinity of the rim trailing edge 376 forms a second rim extension 384 which partially underlies the tab 380. In the serving container 350, the tab 380 is releasably attached to the second rim extension 384 by an adhesive 386. To load the condiment container 370 into the conduit 352, the condiment container 370 is placed through the open top 360 such that tab 380 and the second rim extension 384 extend through the tab slot 368 in the lower sidewall region 358, as is shown in FIG. 22. The condiment container 370 is then pushed down until the first rim extension 382 snaps into the first slot 366, as is shown in FIG. 19. The engagement of the first rim extension 382 with the first slot 366 and of the second rim extension 384 and tab 380 with the tab slot 368 serve to align and affix the condiment container 370 in position with respect to the lower sidewall region 358. The tab slot 368 thus serves as a second slot for engaging the second rim extension 384.

The tab slot 368 also provides a means for maintaining the tab 380 in close proximity to the rim trailing edge 376. The tab slot 368 constrains upwards motion of the tab 380 when the tab 380 is pulled, providing a pull on the sealing sheet 378 which is in a direction substantially parallel to the container rim 372 to avoid dislodging the food product. The tab slot 368 also serves to wipe the sealing sheet 378 if the user pulls the tab 380 upwards against the tab slot 368 as the tab 380 and the sealing sheet 378 are pulled out.

Figure 23:
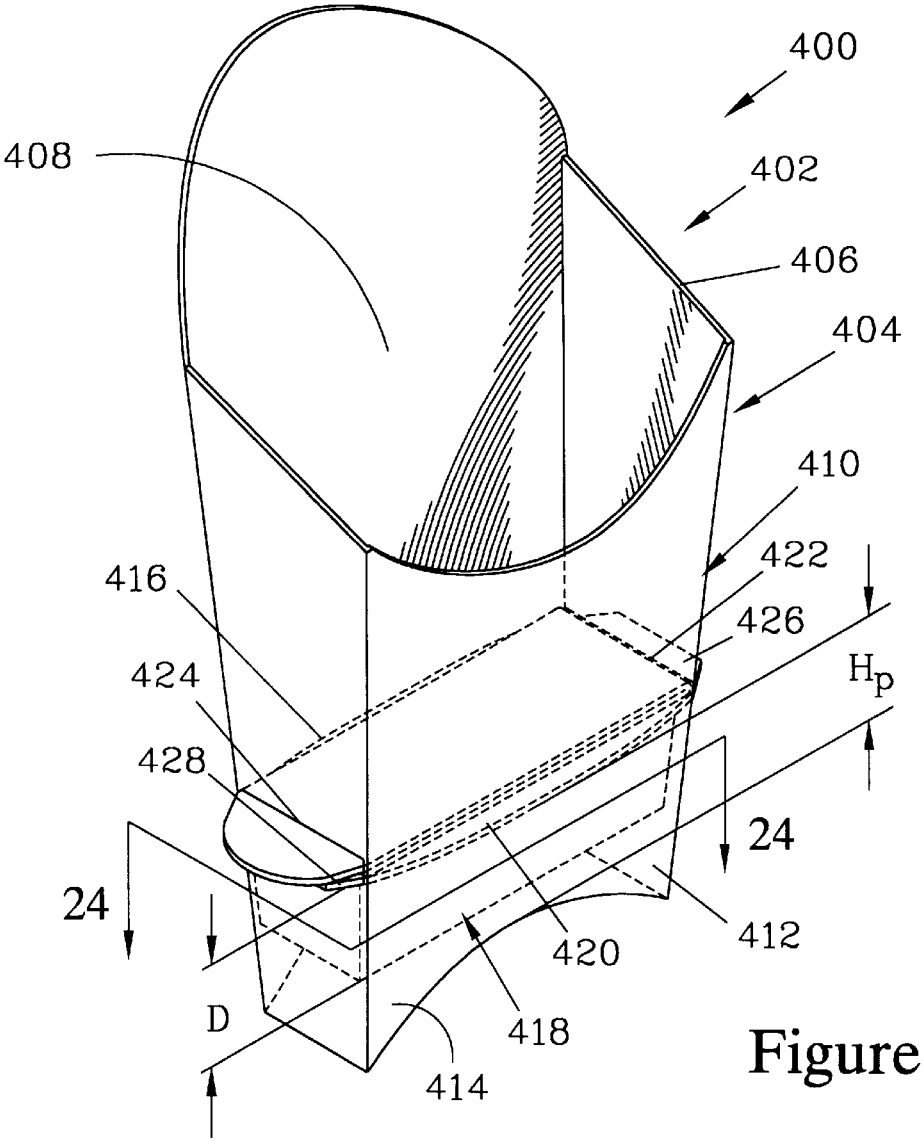
FIGS. 23–24 illustrate another embodiment of the present invention, having a conduit with a curved bottom panel. The curved bottom facilitates the fabrication of a collapsible conduit with improved rigidity, and also facilitates the loading and the lockable engagement of the condiment container with the conduit.
Figure 24:
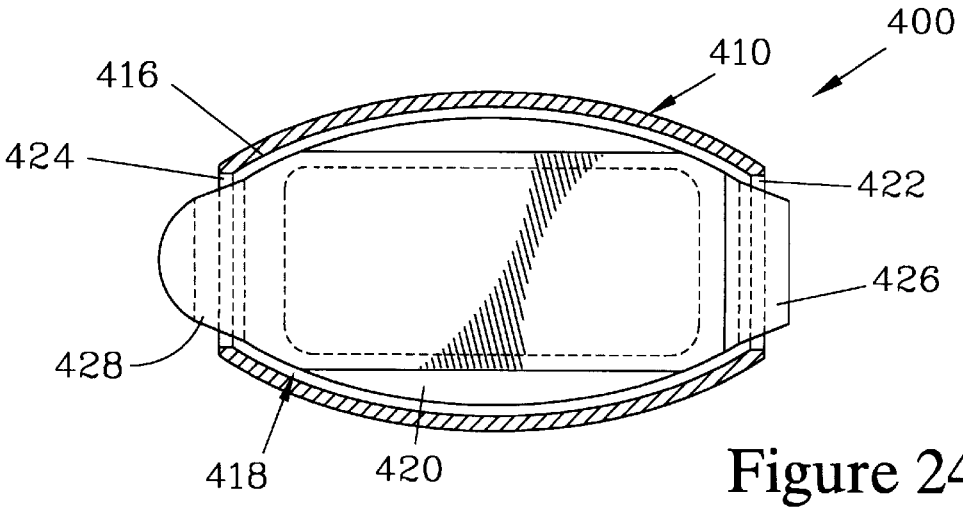

FIGS. 23 and 24 illustrate a serving container 400 which is functionally similar to the serving container 350 discussed above, but which employs a non-rectangular food container 402 as a conduit. The food container 402 has a sidewall 404 with curved segments, which terminates in an upper sidewall region 406, forming an open top 408, and a lower sidewall region 410. The lower sidewall region 410 again has a sidewall extension 412 terminating in a bottom panel 414. In the food container 402, the bottom panel 414 is curved. The food container 402 has a 15 cross-section profile 416 at a profile height $H_p$ above the bottom panel 414.

The serving container 400 has a condiment container 418 which can be lockably engaged with the lower sidewall region 410 of the food container 402 in the same manner as the condiment container 370 and lower sidewall region 358 discussed above. The condiment container 418 has a depth D which is approximately equal to the profile height $H_p$.

The condiment container 418 has a container rim 420 that is shaped to conform to the cross-section profile 416 of the food container 402. The configuration of the container rim 420 prevents the food product from accidentally falling past the condiment container 418, and also allows the container rim 420 to provide structural rigidity to the food container 402. By varying the shape of the container rim 420, the condiment container 418 may be readily adapted for use with various food containers 402.

The lower sidewall region 410 of the serving container 400 is provided with a first slot 422 and a tab slot 424. The container rim 420 has a first rim extension 426 and a second rim extension 428. The curved bottom panel 414 facilitates inserting the second rim extension 428 into the tab slot 424 when loading the condiment container 418 into the food container 402, since the curve provides more space for maneuvering the second rim extension 428. When the condiment container 418 is pushed down until the first rim extension 426 snaps into the first slot 422, the curve of the bottom panel 414 provides pressure to firmly engage the first rim extension 426 with the first slot 422 and the second rim extension 428 with the tab slot 424.

Figure 25:
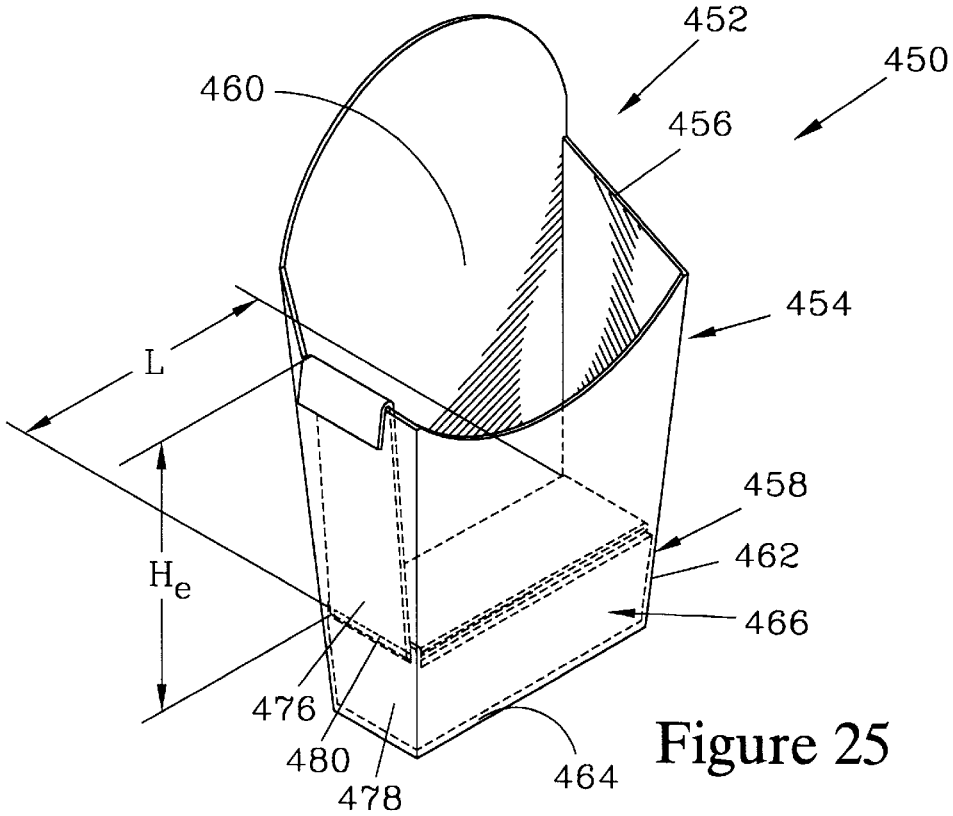
FIGS. 25–27 are isometric views of another embodiment which can employ a conventional food container as a conduit. A condiment container is sealed to the food container.
Figure 26:
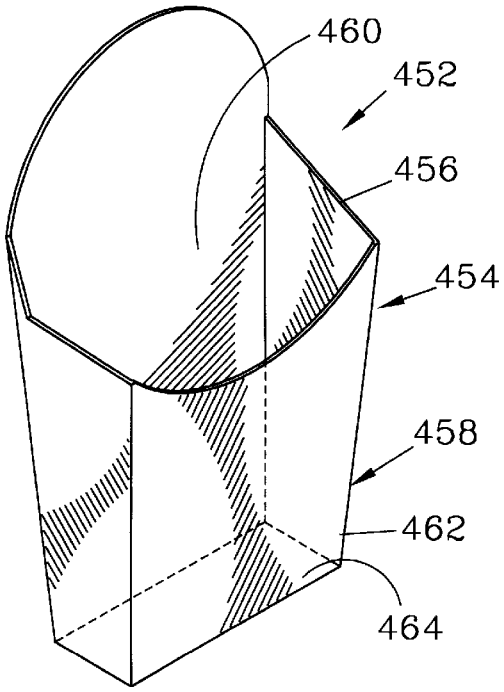
Figure 27:
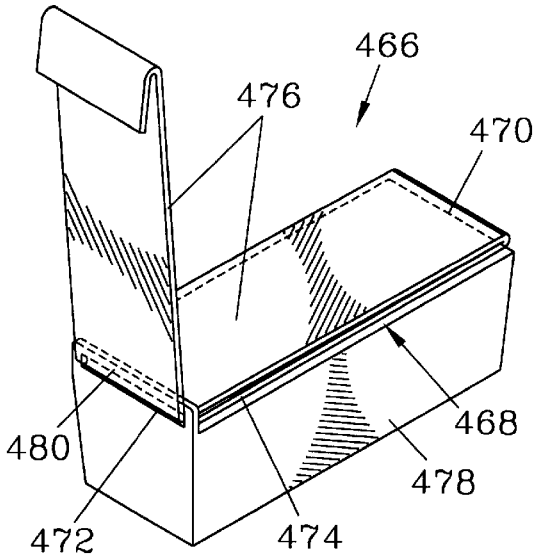

FIGS. 25 through 27 illustrate another embodiment of the present invention, a serving container 450. The serving container 450 has a conduit 452 (shown individually in FIG. 26) formed by a sidewall 454 terminating in an upper sidewall region 456 and a lower sidewall region 458. The upper sidewall region 456 forms an open top 460, while the lower sidewall region 458 has a sidewall extension 462 terminating in a bottom panel 464. Once again, the conduit 452 could be provided by a conventional food container, and in this embodiment modification of the conventional food container to provide the conduit 452 is not required.

The serving container 450 has a condiment container 466 (shown in detail in FIG. 27) which can be affixed the lower sidewall region 458 of the conduit 452 by an adhesive. The condiment container 466 has a container rim 468 with a rim leading edge 470 and a rim trailing edge 472, a sealing sheet 474 attached to the container rim 468, and a tab 476 formed by an extension of the sealing sheet 474.

The condiment container 466 has a reservoir 478, which is configured to substantially conform to the lower sidewall region 458 of the conduit 452. To affix the condiment container 466 with respect to the lower sidewall region 458, the reservoir 478 is simply adhered to the lower sidewall region 458.

To provide means for maintaining the tab 476 in close proximity to the rim trailing edge 472, a constraining edge 480 is provided on the condiment container 466. The constraining edge of this embodiment is fixably positioned with respect to the rim trailing edge 472, and the tab 476 passes beneath the constraining edge 480. When the condiment container 466 is loaded in the conduit 452, the tab 476 extends along a portion of the sidewall 454 to the open top 460, as shown in FIG. 25, where it can readily be grasped by the user.

It is preferred for the dimensions of the serving container 450 to be such that the sealing sheet 474 is maintained within the conduit 452 to avoid any chance of soiling due to contact with the sealing sheet 474, which may be covered with condiment. Thus, when the sealing sheet 474 has a sheet length L, it is preferred for the sidewall 454 of the conduit 452 to have an effective height $H_e$ which is greater than the sheet length L.

While the novel features of the present invention have been described in terms of particular embodiments and preferred applications, it should be appreciated by one skilled in the art that substitution of materials and modification of details obviously can be made without departing from the spirit of the invention.

What I claim is:

1. A serving container for a food product and a dipping condiment, the serving container comprising:

a conduit for supporting a bundle of the food product, said conduit being formed by a sidewall terminating in an upper sidewall region forming an open top and a lower sidewall region;

a condiment container having a container rim with a rim leading edge and a rim trailing edge;

means for aligning and affixing said condiment container with respect to said lower sidewall region of said conduit;

a sealing sheet which peelably engages said container rim, said sealing sheet having a sheet leading edge which engages said rim leading edge and a sheet trailing edge which engages said rim trailing edge;

a tab attached to said sheet leading edge and configured such that it can be extended over said sealing sheet and beyond said sheet trailing edge; and means for maintaining said tab in close proximity to said rim trailing edge.

2. The serving container of claim 1 wherein said tab is formed by an extension of said sealing sheet.

3. The serving container of claim 1 wherein said means for aligning and affixing said condiment container is provided by a lockable engaging mechanism for attaching said container rim with respect to said lower sidewall region of said conduit.

4. The serving container of claim 3 wherein said lockable engaging mechanism further comprises:

a pair of locking edges on said lower sidewall region; and a pair of locking channels on said container rim of said condiment container, said pair of locking channels being grippably engagable with said pair of locking edges.

5. The serving container of claim 1 wherein said means for aligning and affixing said condiment container is provided by sealing said condiment container to said lower sidewall region.

6. The serving container of claim 5 wherein said serving container is configured to be stacked with additional serving containers.

7. The serving container of claim 1 further comprising:

a sidewall extension attached to said lower sidewall region of said sidewall.

8. The serving container of claim 7 wherein said means for aligning and affixing said condiment container is provided by sealing said condiment container to said sidewall extension.

9. The serving container of claim 7 wherein said sidewall extension is provided with a bottom panel.

10. The serving container of claim 9 wherein said means for aligning and affixing said condiment container further comprises:

a first slot in said sidewall extension;

a second slot in said sidewall extension;

a first rim extension on said container rim for engagement with said first slot; and a second rim extension on said container rim for engagement with said second slot.

11. The serving container of claim 10 wherein said means for aligning and affixing said condiment container with respect to said sidewall further comprises:

an aperture in said sidewall extension terminating in one of said first slot and said second slot, said aperture serving to allow insertion of said condiment container into said conduit.

12. The serving container of claim 2 wherein said means for maintaining said tab in close proximity to said rim trailing edge further comprises:

a crank configured to be manually turned by a user of the serving container and having a spindle, said spindle being fixably attached with respect to said tab such that, as said crank is turned, said tab and said sealing sheet are wound onto said spindle; and means for rotatably retaining said crank in a fixed position relative to said rim trailing edge.

13. The serving container of claim 1 wherein said means for maintaining said tab in close proximity to said rim trailing edge is provided by a constraining edge fixably positioned with respect to said rim trailing edge, said tab passing beneath said constraining edge.

14. The serving container of claim 13 wherein said tab extends along a portion of said sidewall to said open top.

15. The serving container of claim 10 wherein said second rim extension is provided in the vicinity of said rim trailing edge, said means for maintaining said tab in close proximity to said rim trailing edge is provided by extending said tab through said second slot.

16. A condiment container for use in combination with a conduit to form a serving container for holding a food product and an associated condiment, the conduit being formed by a sidewall having an upper sidewall region which forms an open top and a lower sidewall region, the condiment container comprising:

a container rim with a rim leading edge and a rim trailing edge;

means for lockably engaging the lower sidewall region of the conduit;

a sealing sheet which peelably engages said container rim, said sealing sheet having a sheet leading edge which engages said rim leading edge and a sheet trailing edge which engages said rim trailing edge;

a tab attached to said sheet leading edge and extending over said sealing sheet to be superimposed over said sheet trailing edge; and means for maintaining said tab in close proximity to said rim trailing edge.

17. The condiment container of claim 16, wherein the lower sidewall region of the conduit is provided with a first slot and a second slot, further wherein said means lockably engaging the lower sidewall region of the conduit further comprises:

a first rim extension on said container rim for engagement with said first slot; and a second rim extension on said container rim for engagement with said second slot.

18. The condiment container of claim 17 wherein said means for maintaining said tab in close proximity to said rim trailing edge is provided by positioning said tab so as to extend through one of said first slot and said second slot of the conduit.

* * * * *